US007784914B2

(12) United States Patent
Dodd et al.

(10) Patent No.: US 7,784,914 B2
(45) Date of Patent: Aug. 31, 2010

(54) FLUID EJECTION DEVICE

(75) Inventors: Simon Dodd, Corvallis, OR (US); Sean P. McClelland, Corvallis, OR (US); Lonnie D. Byers, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 511 days.

(21) Appl. No.: 11/894,088

(22) Filed: Aug. 20, 2007

(65) Prior Publication Data

US 2007/0289132 A1 Dec. 20, 2007

Related U.S. Application Data

(62) Division of application No. 10/696,847, filed on Oct. 30, 2003, now Pat. No. 7,278,706.

(51) Int. Cl.
*B41J 2/05* (2006.01)

(52) U.S. Cl. ..... 347/59

(58) Field of Classification Search ..... 347/44, 347/59, 64

See application file for complete search history.

(56) References Cited

U.S. PATENT DOCUMENTS

| | | | | |
|---|---|---|---|---|
| 4,695,853 | A | 9/1987 | Hackleman et al. | |
| 5,010,355 | A | 4/1991 | Hawkins et al. | |
| 5,159,353 | A | 10/1992 | Fasen et al. | |
| 5,635,968 | A | 6/1997 | Bhaskar et al. | |
| 5,757,394 | A | 5/1998 | Gibson et al. | |
| 5,774,147 | A | 6/1998 | Saito et al. | |
| 5,867,200 | A | 2/1999 | Tajima et al. | |
| 6,102,528 | A | 8/2000 | Burke et al. | |
| 6,309,053 | B1 | 10/2001 | Torgerson et al. | |
| 6,439,703 | B1 | 8/2002 | Anagnostopoulos et al. | |
| 6,504,226 | B1 | 1/2003 | Bryant | |
| 6,543,883 | B1 | 4/2003 | Dodd et al. | |
| 6,582,063 | B1 | 6/2003 | Chavarria et al. | |
| 6,675,476 | B2 * | 1/2004 | Hostetler | 29/890.1 |

* cited by examiner

*Primary Examiner*—An H Do

(57) ABSTRACT

A method of manufacturing a fluid ejection device. A plurality of drive transistors is disposed on a substrate, the drive transistors each comprising contacts. A metal layer is disposed over the contacts. The plurality of drive transistors includes a primitive group of drive transistors, and the metal layer includes a power buss covering each of the contacts of the primitive group of drive transistors.

10 Claims, 3 Drawing Sheets

FLUID EJECTION DEVICE

This is a divisional of U.S. patent application Ser. No. 10/696,847, now U.S. Pat. No. 7,278,706, entitled "FLUID EJECTION DEVICE," filed Oct. 30, 2003, by Dodd et al., and assigned to the present assignee.

BACKGROUND

A fluid ejection device, such as an ink jet printhead, may comprise a substantially linear column of firing chambers with firing resistors. The firing resistors typically have associated drive circuits with drive transistors which energize the resistors to expel fluid from the chamber through an orifice or nozzle. The drive transistors are arranged in a column along side of and substantially parallel with the column of firing resistors. Although a vertical column of resistors is substantially linear, some resistors may be offset horizontally as disclosed, for example, in U.S. Pat. No. 5,635,968.

The fabrication of a fluid ejection device may include a surface etch using an etchant such as TMAH. The etch takes place after the transistors have been fabricated on the substrate. The transistors include contacts which provide an electrical contact to the substrate through vias in an insulation layer. During a subsequent etch, the etchant attacks, i.e. etches away additional portions, of the substrate through openings in the insulation layer through which the contacts pass. The attack often occurs through pinholes located in a passivation layer above the insulation layer in the region of the contacts.

BRIEF DESCRIPTION OF THE DRAWINGS

Features of the invention will readily be appreciated by persons skilled in the art from the following detailed description of exemplary embodiments thereof, as illustrated in the accompanying drawings, in which.

DETAILED DESCRIPTION OF THE DISCLOSURE

Figure 1:
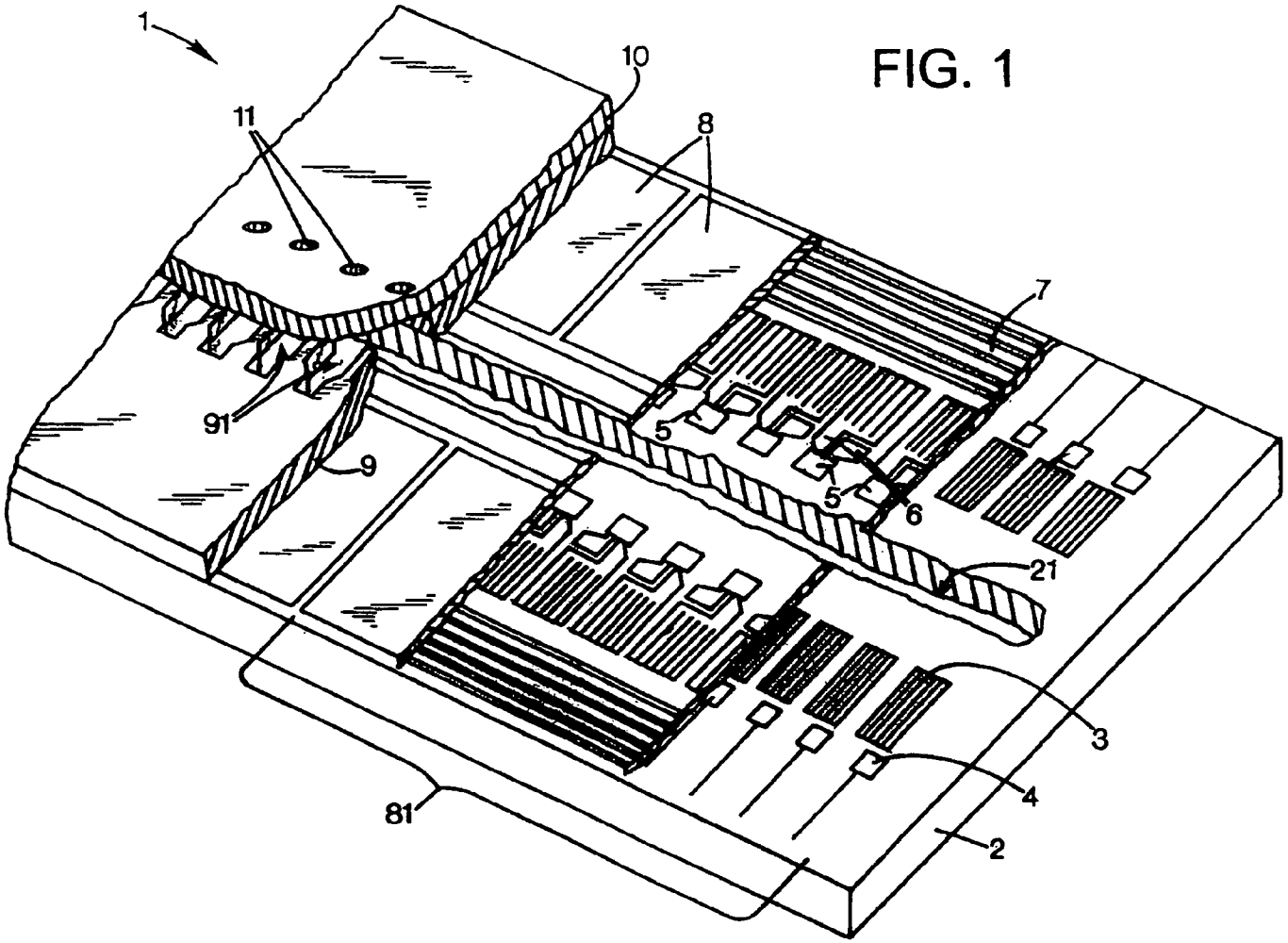
FIG. 1 is a cutaway view of an exemplary embodiment of a fluid ejection device.

In the following detailed description and in the several figures of the drawing, like elements are identified with like reference numerals.

FIG. 1 illustrates an exemplary embodiment of a fluid ejection device 1 in a simplified, partially broken-away, diagrammatic isometric view. The fluid ejection device may comprise a silicon substrate 2. Formed on the substrate, for example by thin film layers, are rows of drive transistors 3 with associated decode logic 4. The drive transistors 3 energize associated, respective resistors 5 or heating elements, however any structure that is capable of heating is capable of being utilized as a resistor. Electrical traces and vias 6 couple the drive transistors 3 to the resistors 5 and address busses 7. Disposed above the drive circuits are primitive power busses or power traces 8. Each primitive power buss 8 is electrically connected to a plurality of drive transistors and provides a common voltage, which acts as a power source, to all of the transistors to which it is connected. The group of transistors 3 and associated, respective resistors 5 powered by a given power buss 8, along with associated firing chambers 91 and nozzles 11, comprise a primitive group 81. In the exemplary embodiment of FIG. 1, two columns of firing resistors are separated by a fluid feed slot 21.

A barrier layer 9 defines a plurality of firing chambers 91, each associated with an individual firing resistor 5. An orifice layer or orifice plate 10 has nozzles 11 formed through the plate. Fluid fed from the feed slot 21 into a firing chamber 91 is heated by a resistor 5 when its associated transistor 3 fires, thereby heating the fluid and expelling some of the fluid out through an orifice 11. In the case of an ejection device which is an inkjet printhead, expelled ink may be propelled onto a media such as paper, mylar, fabric, or other media.

Figure 2A:
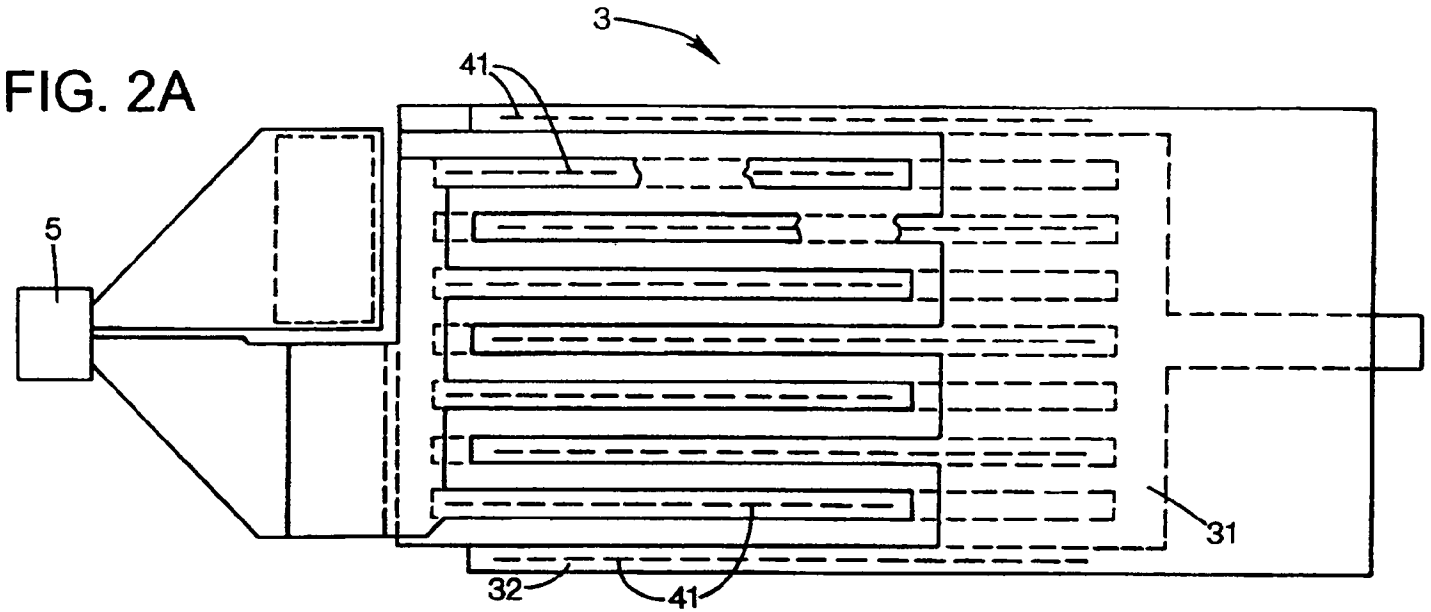
FIG. 2A illustrates a plan view of an exemplary embodiment of a layout of a drive transistor and firing resistor.
Figure 2B:
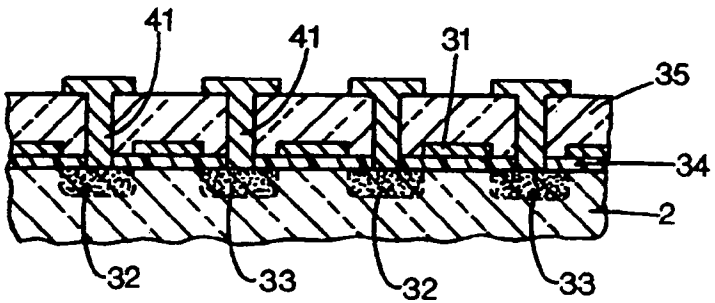
FIG. 2B illustrates a cross-sectional view of the exemplary embodiment of FIG. 2A.

FIGS. 2A and 2B illustrate an exemplary embodiment of a drive transistor 3 and resistor 5. A drive transistor 3 may comprise at least a polysilicon gate portion 31 disposed over a substrate 2. The polysilicon gate portion 31 may be disposed over a gate oxide layer 34 between the substrate and the polysilicon gate portion. Contacts 41 extend through an insulation layer 35 and may contact drain regions 32 or source regions 33, but not substrate 2. The insulation layer 35 may be disposed on the substrate and may be disposed over the polysilicon gate portions and may comprise phosphosilicate glass (PSG). The contacts may comprise PSG contacts, diffusion contacts, drain contacts, source contacts, poly contacts and/or other contacts.

Figure 3:
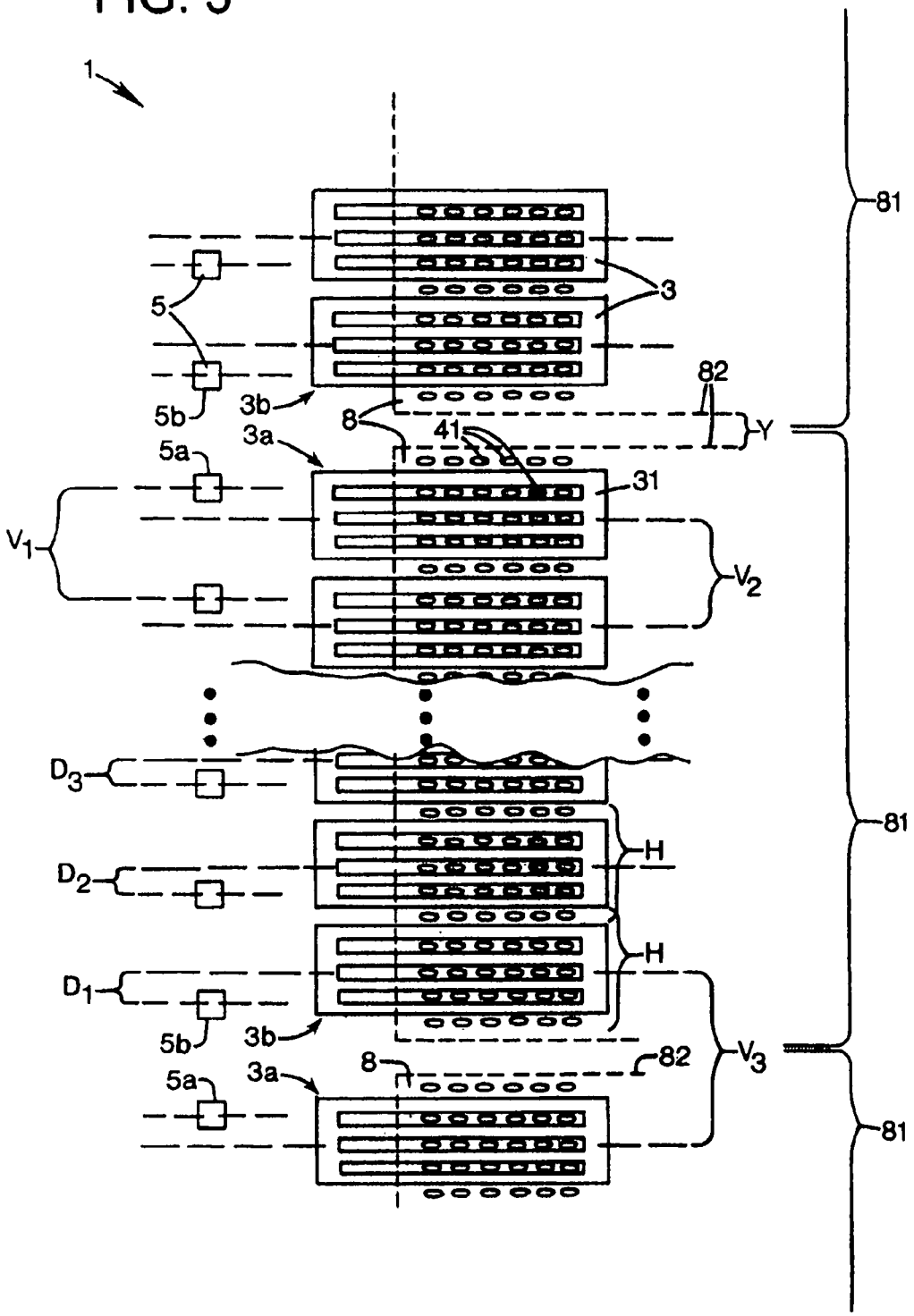
FIG. 3 illustrates an exemplary embodiment layout of transistors and power busses of a fluid ejection device.

FIG. 3 illustrates an exemplary embodiment of a layout of transistors and power busses in a fluid ejection device 1. The fluid ejection device has a plurality of firing resistors 5 and a plurality of associated drive transistors 3. For simplicity, the electrical traces and other features of a drive circuit are omitted from the illustration. For convenience, the columns may be considered as being arranged in a substantially vertical direction, but other orientations are possible and may be utilized with layouts and device structures described herein. For example, the resistors 5 and transistors 3 could be arranged in rows. The resistors 5 in the column may be evenly and uniformly spaced along the column. For instance, each resistor may be uniformly spaced, centerline-to-centerline, a vertical distance V1 from adjacent resistors along the column. In an exemplary embodiment, the resistors may be spaced, centerline-to-centerline, about 84.7 um apart. The resistors may have dimensions of about 28.6×14.2 um and may comprise split resistors with two halves separated by a gap of about 2 um. The centerline referred to in this exemplary embodiment is the horizontal line running through a point halfway between the uppermost extent of a resistor and the lowermost extent of that resistor. In this embodiment, the resistors are illustrated as of a rectilinear shape. In other embodiments, a different shape may be employed and/or a different centerline may be selected. Although the resistors 5 in FIG. 3 are shown in a column, in certain, alternative embodiments, the horizontal placement of some resistors along the column may be offset to one side or the other. In some embodiments, the resistors may not be uniformly spaced.

In this embodiment, the resistors 5 and transistors 3 of a column are arranged in primitive groups 81. The resistors 5 and associated, respective transistors 3 in a primitive group are each electrically connected to a common one of the plurality of power busses 8. In FIG. 3, the perimeter 82 of the areas covered by power busses 8 are designated with dotted lines. In an exemplary embodiment, a power buss 8 may be disposed as a conductive layer over the drive transistors 3, as shown in FIG. 1. The power busses 8 may comprise an electrically conductive layer which may comprise tantalum, gold, other metal, other conductive material, or alloys thereof. In an exemplary embodiment, the power buss 8 may have dimensions of about 2177.5×198 um. A primitive group 81 may comprise 26 resistors 5 and 26 transistors 3.

The transistors may comprise a polysilicon gate portion 31 and contacts 41. In an exemplary embodiment, the contacts 41 lying between adjacent transistors 3 within a primitive group 81 may act as a contact 41 for the transistors on either side of the contacts 41. An exemplary transistor has a vertical height H. The height H may be defined between the outermost contacts which provide the electrical connection to the polysilicon, or the doped polysilicon or silicon substrate, as appropriate. The transistors 3 may be placed close together. Contacts 41 may be shared by adjacent transistors 3. In an exemplary embodiment, a transistor 3 may have dimensions of about 77.5×198 um.

The height of a transistor may be selected, in part, to provide desirable transistor efficiency. The overall efficiency of a transistor may be related, in part, to the surface area covered by the transistor. A transistor with a height H which is too small, may have an impedance which is too high for desired efficiency of operation. In FIG. 3, the transistors are shown, by way of example, with four polysilicon legs. The efficiency of the transistor may be increased, for example, by adding additional legs and corresponding additional drain and source regions and contacts as appropriate. In an exemplary embodiment, a transistor with desirable efficiency characteristics may have as many as eight polysilicon gate legs or more.

In an exemplary embodiment, transistors of a given primitive group may be uniformly spaced along the column of transistors. In FIG. 3, for example, the transistors 3 within a primitive group 81 are spaced, centerline-to-centerline, a distance V2 apart from adjacent transistors of the primitive group. In an exemplary embodiment, the transistors within a primitive group may be spaced, centerline-to-centerline, about 84 um apart. The spacing of the transistors 3 of a primitive group may be different from the spacing of the resistors of a primitive group. In FIG. 3, for example, the separation distance V2 of the transistor spacing is smaller than the separation distance V1 of the resistor spacing. The centerline referred to in this exemplary embodiment is the horizontal line running through a point halfway between the uppermost extent of the transistor and the lowermost extent of the transistor. In this embodiment, the transistors are illustrated as having a rectilinear shape. In other embodiments, a different transistor shape may be employed and/or a different centerline may be selected.

An upper-most transistor 3*a* of a primitive group 81 may be offset vertically downward from its associated, respective resistor 5*a*, and a lower-most transistor 3*b* of the primitive group 81 may be offset vertically upward from its associated, respective resistor 5*b*. The amount of vertical offset between each resistor in a primitive group and its respective transistor may be different for each pair or one or more pairs may be offset by different distances. In FIG. 3, for example, the vertical offset D1 is greater than the vertical offset D2 which, in turn, is greater than the vertical offset D3. In an exemplary embodiment, the vertical offsets D1, D2 and D3 may be about 6.5 um, 5.8 um and 5.1 um, respectively. The relative offset may decrease as one moves from the upper and/or lower resistor/transistor pairs toward the center of a primitive group 81. For a transistor near the vertical centerline of a power buss, there may be the smallest vertical offset of the primitive group 81 between a resistor and its associated transistor.

As a result, adjacent transistors of adjacent primitive groups, for example the upper-most transistor 3*a* of a primitive group 81 and the lower-most transistor 3*b* of an adjacent primitive group 81 may be spaced further from each other than spacing of the transistors within either one of the adjacent primitive groups 81. In FIG. 3, for example, an upper-most transistor 3*a* and a lower-most transistor 3*b* are spaced, centerline to centerline, a distance V3 apart, the distance V3 being greater than V1. In an exemplary embodiment, the upper-most transistor 3*a* and a lower-most transistor 3*b* may be spaced, centerline-to-centerline, about 100.4 um apart. In an alternative exemplary embodiment, the distance V3 could be less than V1.

In the exemplary embodiment of FIG. 3, each of the contacts 41 of the transistors 3 in each primitive group 81 are completely covered by and/or enclosed within the perimeter 82 of the area covered by the power buss 8. The power buss 8 may comprise a protective layer over the contacts 41. The power buss 8 may protect the substrate from chemical attack during an etch which may occur during manufacture of the fluid ejection device subsequent to laying down transistor 3, resistors 5 and the busses 8.

However, only a portion of each of the contacts 41 may be covered by power buss 8. The portion covered needs to be of sufficient to make a reliable electrical path between power buss 8 and contacts 41. The actual area of the covered portion is a function of contact surface area and transistor size.

An exemplary etch step may be a wet etch using an etchant, which may be TMAH. The etch step may define, in part, an ink feed slot 21 (FIG. 1). In an exemplary embodiment, an ink feed slot may be formed by a process comprising at least two steps. The two steps may be, for example, a wet etch followed by sand blasting. However, other methods and approaches including, but not limited to, laser drilling, drilling, or the like may be used. Without the protective layer, the etchant may attack the substrate through pinholes in a passivation layer over the PSG layer, in the region where the contacts pass through the insulation layer or PSG layer. The etchant may also attack the substrate directly through the contacts. The substrate may be "attacked" in areas of silicon that should not be etched, but which are unintentionally etched during the wet etch process. This may be due to passivation pinholes caused by uniformity and topology issues.

A power buss 8 may be arranged to cover each of the contacts of each of the transistors in the associated primitive group. The process of covering each of the contacts with a protective layer prior to an etch improved yield over a process in which each of the contacts were not covered by a protective layer.

The desired, minimum separation between the edges of adjacent power busses to achieve, in order to provide reliable electrical separation of the power busses, may depend on or be limited by the particular photo and etch tooling used in the manufacture of the fluid ejector. In an exemplary embodiment, the vertical distance Y (FIG. 3) between adjacent power busses 8 may be limited to about 8 um. Power buss separation is limited by the photo and etch tooling used in depositing the protective layer. In certain embodiments, an etchant used in the wet etch may remove material from along the edges of the power buss 8. As a result, the spacing between adjacent power busses 8 after the etch may be as much as about 2-4 additional microns larger than the gap prior to the etch. The minimum post-etch gap spacing may therefore be approximately 9.5-10 microns or more in the exemplary embodiment.

In an exemplary embodiment of a fluid ejection device 1, the vertical spacing or separation distance V1 of the resistors is dependent on the desired print quality as measured in dpi (dots per inch). In an exemplary embodiment, the distance V1 provides a resolution of up to 1200 dpi (1200×2400).

In FIG. 3, for example, if the upper most transistors 3*a* and adjacent lower most transistors 3*b* of adjacent primitive groups 81 were spaced the same distance apart as the resistors 5*a* and 5*b* and were not vertically offset from the resistors, some of the contacts would extend into the space Y between the power busses 8. If the space Y were already set as the minimum separation between adjacent power busses, it would not be possible to cover each of the contacts of the upper or lower most contacts with the protective layer of the power buss 8. If the transistors were simply made narrower, to increase the gap between transistors, efficiency of the transistors may be compromised or desirable efficiencies would not be achieved.

In the exemplary arrangement of transistors shown in FIG. 3, the transistors 3 within a primitive group 81 are spaced a distance V2 apart, V2 being smaller than the distance V3 between adjacent transistors of adjacent primitive groups 81. This enables a fluid ejection device 1 or printhead die of a given length to accommodate more transistors 3 of a given vertical height H while also providing power busses 8 which cover each of the contacts 41 of the transistors 3 of the associated primitive groups 81.

In other exemplary embodiments, the vertical spacing of the resistors 5 within a primitive group 81 may not be uniform. The vertical spacing of the transistors 3 of a primitive group 81 may not be spaced uniformly within the primitive group and/or the vertical spacing of the transistors 3 along a column of transistors may not match the spacing of the associated, corresponding resistors 5 along the associated column of resistors. Spacing lower most transistors 3*b* sufficiently far from upper most transistors 3*a* between adjacent primitive groups 81 will allow adjacent power busses 8 to be sufficiently separated to provide electrical isolation of the adjacent power busses 8 while providing a protective covering over the contacts 41 of all of the transistors 3 of each primitive group 81. Within the primitive group 81, the transistors may be spaced as close or as far apart as desired. The transistors 3 of a primitive group 81 may be spaced more closely than the associated, respective resistors 5 of the primitive group 81. The spacing of transistors 3 within a primitive group 81 may be closer than the spacing between the lower most transistor of one primitive group and the upper-most transistor of an adjacent primitive group 81. This arrangement or layout of transistors 3 may provide more efficient use of space on the silicon die. The spacing of transistors 3 within one primitive group 81 may be different from the spacing of transistors 3 within another primitive group 81.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method of manufacturing a fluid ejection device, comprising:

disposing a plurality of drive transistors on a substrate, the drive transistors each comprising contacts; and disposing a metal layer over the contacts; and wherein the plurality of drive transistors comprises a primitive group of drive transistors, and wherein the metal layer comprises a power buss covering each of the contacts of the primitive group of drive transistors.

2. The method of claim 1, further comprising a surface etch with an etchant.

3. The method of claim 2, wherein the etchant comprises TMAH.

4. The method of claim 2, wherein the power buss is disposed prior to the etch.

5. The method of claim 1 where covering each of the contacts by the power buss forms a protective layer over the contacts.

6. A method of manufacturing a fluid ejection device, comprising:

fabricating a vertical column of drive transistors on a substrate, the drive transistors having contacts and the vertical column of drive transistors comprising a primitive group of drive transistors;

fabricating a power buss over the contacts of the drive transistors of the primitive group; and wherein the power buss has a perimeter defining an area, the area enclosing the contacts of the drive transistors of the primitive group.

7. The method of claim 6, further comprising a surface etch with an etchant.

8. The method of claim 7, wherein the etchant comprises TMAH.

9. The method of claim 7, wherein the power buss is fabricated prior to the etch.

10. The method of claim 7 where fabricating the power buss includes electrically connecting the power buss to the contacts of the drive transistors and where the power buss forms a protective layer covering the contacts of the drive transistors.

* * * * *